US010337518B2

(12) United States Patent
King et al.

(10) Patent No.: US 10,337,518 B2
(45) Date of Patent: Jul. 2, 2019

(54) VARIABLE TURBINE GEOMETRY TURBOCHARGER VANE PACK RETAINER

(71) Applicant: BorgWarner Inc., Auburn Hills, MI (US)

(72) Inventors: Matthew King, Arden, NC (US); Elias Morgan, Leicester, NC (US)

(73) Assignee: BorgWarner Inc., Auburn Hills, MI (US)

( * ) Notice: Subject to any disclaimer, the term of this patent is extended or adjusted under 35 U.S.C. 154(b) by 761 days.

(21) Appl. No.: 14/883,832

(22) Filed: Oct. 15, 2015

(65) Prior Publication Data

US 2016/0123334 A1 May 5, 2016

Related U.S. Application Data

(60) Provisional application No. 62/072,467, filed on Oct. 30, 2014.

(51) Int. Cl.

| | |
|---|---|
| ***F04D 25/02*** | (2006.01) |
| ***F04D 25/04*** | (2006.01) |
| ***F04D 29/46*** | (2006.01) |

(52) U.S. Cl.

CPC ..... *F04D 25/024* (2013.01); *F04D 25/04* (2013.01); *F04D 29/462* (2013.01)

(58) Field of Classification Search

CPC ..... F04D 25/024; F04D 29/462; F04D 25/04; F04D 29/46; F02C 6/12; F02B 37/24

See application file for complete search history.

(56) References Cited

U.S. PATENT DOCUMENTS

| | | | | |
|---|---|---|---|---|
| 6,729,134 | B2 * | 5/2004 | Arnold | F01D 5/141 415/144 |
| 2012/0189433 | A1 * | 7/2012 | Baker | F01D 17/14 415/158 |
| 2013/0036733 | A1 * | 2/2013 | Severin | F01D 17/165 60/605.1 |

* cited by examiner

*Primary Examiner* — Richard A Edgar
*Assistant Examiner* — Michael L Sehn
(74) *Attorney, Agent, or Firm* — BrooksGroup

(57) ABSTRACT

A variable turbine geometry turbine turbocharger (1) includes a vane pack (50) disposed in the exhaust gas path upstream of the turbine wheel (12). The vane pack (50) includes vanes (30) that are rotatably supported between a pair of vane rings (34) and configured to adjustably control the flow of exhaust gas to the turbine wheel (12). In addition, a retainer (60, 160) secures the vane pack (50) to the bearing housing (16) in such a way that the vane pack (50) is mechanically decoupled from the turbine housing (4).

10 Claims, 4 Drawing Sheets

VARIABLE TURBINE GEOMETRY TURBOCHARGER VANE PACK RETAINER

CROSS-REFERENCE TO RELATED APPLICATIONS

This application claims priority to and all the benefits of U.S. Provisional Application No. 62/072,467, filed on Oct. 30, 2014, and entitled "VTG Turbocharger Vane Pack Retainer," which is incorporated herein by reference.

FIELD OF THE INVENTION

Embodiments are generally related to turbochargers and, more particularly, to a vane pack retainer for use in variable turbine geometry (VTG) turbochargers.

BACKGROUND

Exhaust gas turbochargers are provided on an engine to deliver air to the engine intake at a greater density than would be possible in a normal aspirated configuration. Turbochargers typically include a turbine housing connected to the exhaust manifold of the engine, a compressor housing connected to the intake manifold of the engine, and a bearing housing coupled between the turbine and compressor housings. A turbine wheel in the turbine housing is rotatably driven by an inflow of exhaust gas supplied from the exhaust manifold. A shaft rotatably supported in the bearing housing connects the turbine wheel to a compressor impeller in the compressor housing so that rotation of the turbine wheel causes rotation of the compressor impeller. As the compressor impeller rotates, the air mass flow rate, airflow density, and air pressure delivered to cylinders of the engine via the intake manifold is increased.

Thus, turbochargers deliver compressed air to an engine allowing fuel to be combusted more efficiently. A Diesel engine operates at higher air-to-fuel ratios with higher efficiency compared to other engine cycles. Turbocharging is an efficient approach to increasing air-to-fuel ratio for the Diesel engine combustion cycle. In the case of other engine configurations and combustion cycles, turbocharging is an effective method for increasing power density. An increase in power density, allows the use of smaller, lighter engines at similar power levels. The use of a smaller engine in a vehicle decreases the mass of the vehicle, increases performance, and enhances fuel economy. Moreover, since turbochargers provide a more complete combustion of the fuel delivered to the engine, engine emissions can be reduced.

SUMMARY

In some aspects, a variable turbine geometry turbine turbocharger includes a bearing housing having an axially extending bore, and a rotating assembly including a shaft rotatably supported in the bore. The turbocharger includes a compressor wheel secured to one end of the shaft and a turbine wheel secured to another end of the shaft. The turbocharger includes a turbine housing including an exhaust gas inlet, an exhaust gas outlet, a volute disposed in a fluid path between the exhaust gas inlet and the exhaust gas outlet. The turbine wheel is disposed in the turbine housing between the volute and the exhaust gas outlet. In addition, the turbocharger includes a vane pack disposed in the fluid path between the volute and the turbine wheel. The vane pack includes vanes rotatably supported between a pair of vane rings and configured to adjustably control the flow of exhaust gas to the turbine wheel, and a retainer configured to secure the vane pack to the bearing housing in such a way that the vane pack is mechanically decoupled from the turbine housing.

The turbocharger may include one or more of the following features: a pair of vane rings including an upper vane ring disposed on a bearing housing-facing side of the vanes, and a lower vane ring disposed on a turbine housing-facing side of the vanes, wherein the upper vane ring is clamped between the retainer and the bearing housing; the upper vane ring is an annular plate having bearing housing-facing surface and an opposed, turbine housing-facing surface, the turbine housing-facing surface including a circumferentially extending recess formed along an inner diameter thereof, and the retainer includes an annular flange that is received in the recess; the retainer further including a hollow, cylindrical base portion disposed in the bore so as to be coaxial with the shaft, and an annular plate portion extending from one end of the base portion, the plate portion disposed between the turbine wheel and the bearing housing; the plate portion is configured to engage one vane ring of the pair of vane rings, and the base portion is fixed to the bore, whereby the retainer secures the vane pack to the bearing housing; the base portion including threads formed on an outer surface thereof that engage corresponding threads formed on an inner surface of the bore, whereby the retainer is fixed to the bearing housing; the plate portion is non-planar and has a shape that matches a shape of a backface of the turbine wheel; and the plate portion further including an inner end connected to the one end of the base portion, the annular flange that is radially spaced apart from the inner end, and a concave portion that extends between the inner end and the annular flange.

In some aspects, a variable turbine geometry turbine turbocharger includes a bearing housing having an axially extending bore, and a rotating assembly including a shaft rotatably supported in the bore. The turbocharger includes a compressor wheel secured to one end of the shaft and a turbine wheel secured to another end of the shaft. The turbocharger includes a turbine housing including an exhaust gas inlet, an exhaust gas outlet, a volute disposed in a fluid path between the exhaust gas inlet and the exhaust gas outlet, the turbine wheel disposed in the turbine housing between the volute and the exhaust gas outlet. In addition, the turbocharger includes a vane pack disposed in the fluid path between the volute and the turbine wheel, the vane pack comprising vanes rotatably supported between a pair of vane rings and configured to adjustably control the flow of exhaust gas to the turbine wheel. The vane pack is mechanically decoupled from the turbine housing.

The turbocharger may include one or more of the following features: a vane pack that is retained on the bearing housing via a retainer; a pair of vane rings including an upper vane ring disposed on a bearing housing-facing side of the vanes, and a lower vane ring disposed on a turbine housing-facing side of the vanes, and the upper vane ring is clamped between the retainer and the bearing housing; the retainer including a hollow, cylindrical base portion disposed within the bore so as to be coaxial with the shaft and fixed relative to the bearing housing, and an annular plate portion extending from one end of the base portion, the annular plate portion disposed between the turbine wheel and the bearing housing; the plate portion is configured to engage one vane ring of the pair of vane rings, and the base portion is fixed to the bore, whereby retainer secures the vane pack to the bearing housing; the base portion further including threads formed on an outer surface thereof that engage corresponding threads formed on an inner surface of the bore, whereby the retainer is fixed to the bearing housing; and the base portion is secured to the bore via a spring clip.

A turbocharger provides an ideal boost in only a limited range of conditions. Thus, in general, a larger turbine for a given engine provides good boost at high speeds, but does not do well at low speeds because it suffers turbo lag and is thus unable to provide boost when needed. A small turbine provides good boost at low speeds, but can choke the engine at high speeds. One solution to this problem is to provide the turbocharger with a variable turbine geometry (VTG) turbine having a vane pack including pivotable vanes in the turbine housing. At low speeds, when boost is needed quickly, the vanes can be closed creating a narrower passage for the flow of exhaust gas. The narrow passage accelerates the exhaust gas towards the turbine wheel blades allowing the turbocharger to provide a boost of power to the engine when needed. On the other hand, when the engine is running at high speed and the pressure of the exhaust gas is high, the vanes may be opened and the turbocharger provides the appropriate amount of boost to the engine for the associated speed. By allowing the vanes to open and close, the turbocharger is permitted to operate under a wide variety of driving conditions as power is demanded by the engine.

Because the turbine housing is not symmetrically round in a radial plane, and because the heat flux within the turbine housing is also not symmetrical, the turbine housing is subject to asymmetric stresses and asymmetric thermal deformation due to the presence of high temperature exhaust gas therein. Thermal deformation in the turbine housing is transferred to the vane pack, which can cause the vane pack to wear, stick, or lock up. In addition, the materials used in the components of the vane pack tend to creep (e.g., flow, deform) over the service life of the turbocharger as a result of the long-term exposure to high levels of stress and high temperatures within the turbocharger. As is well known, creep increases with temperature and load, and is more severe in materials that are subjected to heat for long periods. Thus, the turbocharger must be configured to accommodate thermal expansion and creep in such a way as to prevent lock-up of the vane pack, and extend the longevity of the turbocharger. These negative thermal effects are exacerbated by the fact that there is a trend to operate turbochargers at relatively higher exhaust temperatures in order to further reduce emissions and/or obtain better performance. Moreover, the requirement to operate at elevated temperatures often leads to the use of more expensive materials to accommodate increased thermal loads.

In some aspects, a variable turbine geometry turbine turbocharger includes a vane pack disposed in the exhaust gas path upstream of the turbine wheel and a retainer. The vane pack includes vanes rotatably supported between a pair of vane rings and configured to adjustably control the flow of exhaust gas to the turbine wheel, and the retainer is configured to secure the vane pack to the bearing housing in such a way that the vane pack is mechanically decoupled from the turbine housing.

Using the retaining ring to clamp the vane pack to the bearing housing has several advantages. For example, since the vane pack is secured to the bearing housing rather than the turbine housing, conductive heat transfer to the vane pack from the turbine housing is eliminated, reducing thermal distortion of the vane pack during turbocharger operation. In addition, conductive heat transfer to the bearing housing may also be reduced.

In another example, since the retaining ring retains the vane pack via a clamped engagement, thermal growth of the vane pack during turbocharger operation is accommodated. In addition, the retainer has some elasticity, and serves as a spring that retains the securely clamped configuration of the vane pack relative to the bearing housing even after long term operation at high temperatures.

Moreover, since the retaining ring engages the vane pack at an inner diameter thereof, vane pack thermal growth, and particularly radial thermal growth, can occur with minimal distortion. This can be compared to vane pack distortion than can be caused in some conventional VTG vane packs that are secured to the turbine housing via bolts whereby bolted regions of the vane pack are prevented from thermal growth and regions intermediate the bolted regions experience thermal growth.

In another example, using the retainer to secure the vane pack to the bearing housing requires fewer parts and permits easier assembly than some conventional VTG vane packs that are secured to the turbine housing via bolts.

In another example, since portions of the retainer are disposed between the turbine wheel and the bearing housing, the retainer serves as a heat shield that reduces heat transfer from the turbine wheel and the turbine housing to the bearing housing. By using the retainer as a heat shield, the conventional heat shield can be omitted, further reducing the number of parts and costs of the turbocharger assembly.

BRIEF DESCRIPTION OF THE DRAWINGS

Advantages of the VTG turbocharger disclosed herein will be better understood by reference to the following detailed description when considered in connection with the accompanying drawings wherein.

DETAILED DESCRIPTION OF THE INVENTION

Figure 1:
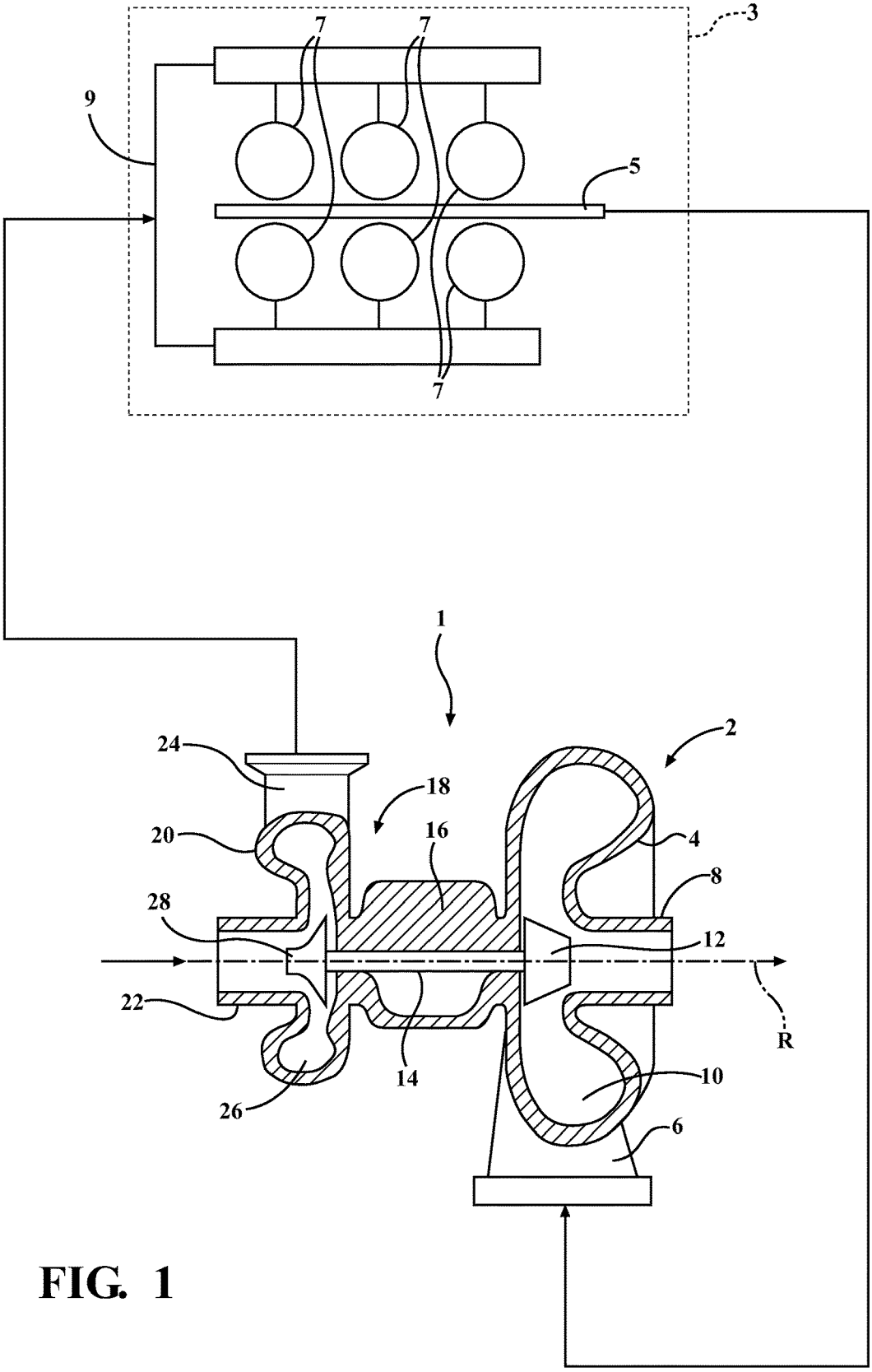
FIG. 1 is a schematic illustration of an engine system including a VTG turbocharger.

Referring to FIG. 1, an exhaust gas turbocharger 1 includes a turbine section 2, a compressor section 18, and a bearing housing 16 disposed between and connecting the compressor section 18 to the turbine section 2. The turbine section 2 includes a turbine housing 4 that defines an exhaust gas inlet 6, an exhaust gas outlet 8, and a turbine volute 10 disposed in the fluid path between the exhaust gas inlet 6 and the exhaust gas outlet 8. A turbine wheel 12 is disposed in the turbine housing 4 between the turbine volute 10 and the exhaust gas outlet 8. A shaft 14 is connected to the turbine wheel 12, is supported for rotation about a rotational axis R within in the bearing housing 16, and extends into the compressor section 18. The compressor section 18 includes a compressor housing 20 that defines an axially-extending air inlet 22, an air outlet 24, and a compressor volute 26. A compressor wheel 28 is disposed in the compressor housing 20 between the air inlet 22 and the compressor volute 26, and is connected to the shaft 14.

In use, the turbine wheel 12 in the turbine housing 4 is rotatably driven by an inflow of exhaust gas supplied from the exhaust manifold 5 of an engine 3. The rotation of the turbine wheel 12 causes rotation of the compressor wheel 28 via the shaft 14. Rotation of the compressor wheel 28 increases the air mass flow rate, airflow density and air pressure delivered to cylinders 7 of the engine 3 via an outflow from the compressor air outlet 24, which is connected to an air intake manifold 9 of the engine 3.

Figure 2:
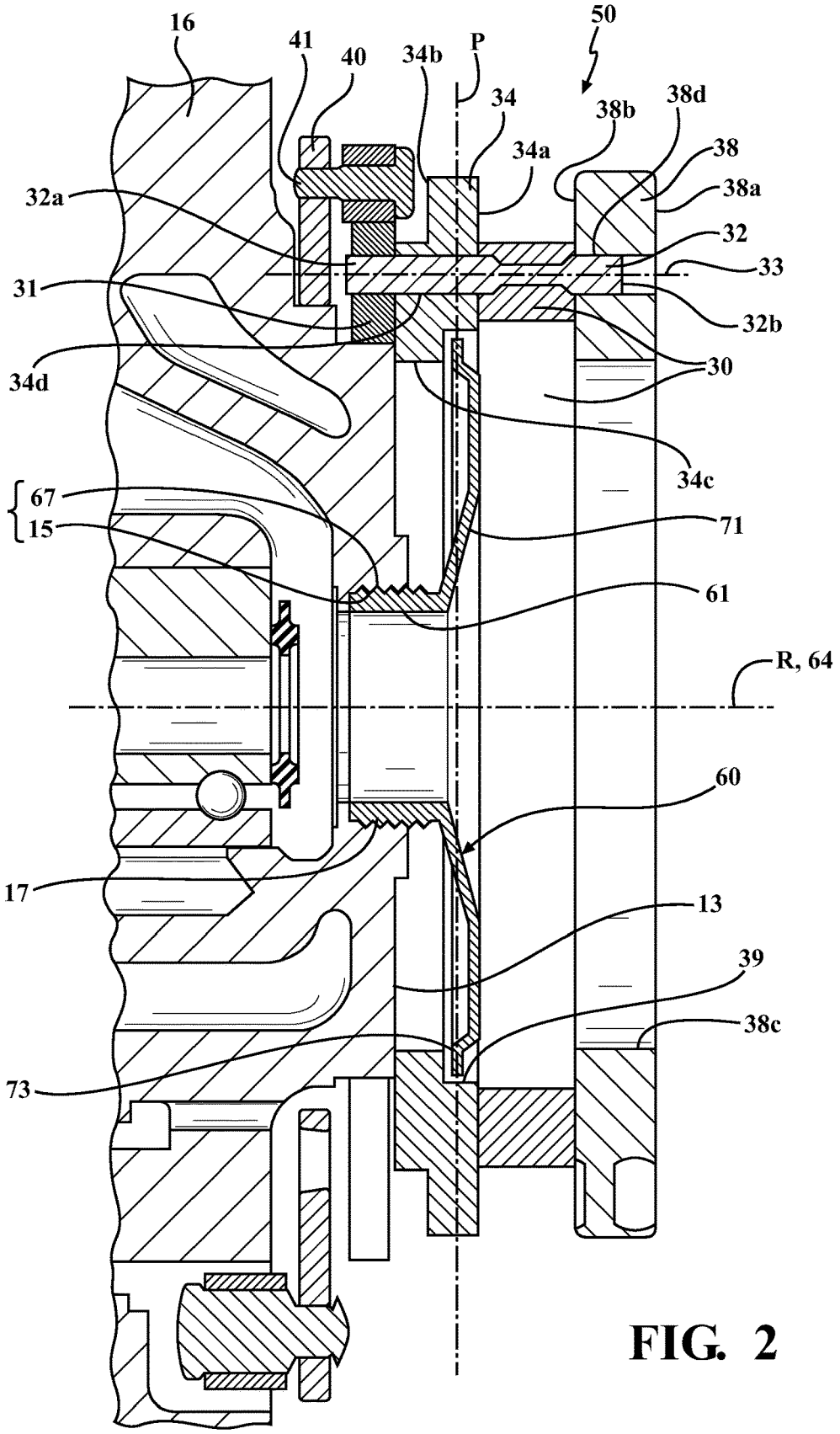
FIG. 2 is a cross-sectional view of the vane pack and retainer of the VTG turbocharger of FIG. 1.

Referring to FIG. 2, the turbocharger 1 is a variable turbine geometry turbocharger. In particular, the turbine section 2 includes a plurality of pivotable vanes 30 which control the flow of exhaust gas that impinges on the turbine wheel 12 and thus control the power of the turbine section 2. The vanes 30 also therefore control the pressure ratio generated by the compressor section 18. In engines that control the production of NOx by the use of High Pressure Exhaust Gas Recirculation (HP EGR) techniques, the vanes 30 also provide a means for generating and controlling exhaust back pressure.

The vanes 30 are arranged in a circular array around the turbine wheel 12, and are located between the turbine volute 10 and the turbine wheel 12. The vanes 30 are pivotably supported in this configuration between an upper vane ring 34 disposed on a bearing housing-facing side of the vanes 30, and a lower vane ring 38 disposed on a turbine housing-facing side of the vanes 30. The sub-assembly consisting of the plurality of vanes 30, the upper vane ring 34 and the lower vane ring 38 is referred to as the vane pack 50.

Each of the upper and lower vane rings 34, 38 is an annular plate having a turbine housing-facing surface 34*a*, 38*a*, an opposed, bearing housing-facing surface 34*b*, 38*b*, and a central opening 34*c*, 38*c* in which the turbine wheel 12 resides. The turbine housing-facing surface 34*a* of the upper vane ring 34 includes a recess 39 formed along an inner diameter thereof. The recess 39 extends about the inner circumference of the upper vane ring 34, and is configured to receive an annular flange 73 of a retainer 60 therein, as discussed further below.

Each vane 30 rotates on a post 32 that protrudes from opposed side faces (not labeled) of the vane 30, with the post 32 having a rotational axis 33. Opposed free ends 32*a*, 32*b* of the post 32 are received in respective apertures 34*d*, 38*d* in the upper vane ring 34 and the lower vane ring 38. The angular orientation of the upper vane ring 34 relative to the lower vane ring 38 is set such that the corresponding apertures in the vane rings 34, 38 are concentric with the axis 33 of the post 32, and the vane 30 is free to rotate about the axis 33 of the post 32. Each post 32 on the upper vane ring-side of the vane 30 protrudes through corresponding aperture of the upper vane ring 34 and is affixed to a vane arm 31, which controls the rotational position of the vane 30 with respect to the vane rings 34, 38.

The vane orientation within the vane pack 50 is adjusted using an adjustment ring 40, which includes pins 41 that engage the vane arms 31. Thus, the position of each vane 30 is adjusted in unison with the other vanes 30 as the adjustment ring 40 is rotated. The adjustment ring 40 is controlled by an actuator (not shown) which is operatively connected to rotate the adjustment ring 40 via a linkage (not shown). The actuator is typically commanded by the engine electronic control unit (ECU).

The vane pack 50 is provided as a unitized subassembly (e.g., the vane pack 50 is configured to remain in the assembled configuration as a unit before, during, and after assembly with the turbocharger 1), and is retained in the desired configuration relative to the turbine housing 4 and turbine wheel 12 via the retainer 60 that secures the vane pack 50 to the bearing housing 16, as discussed further below.

Figure 3:
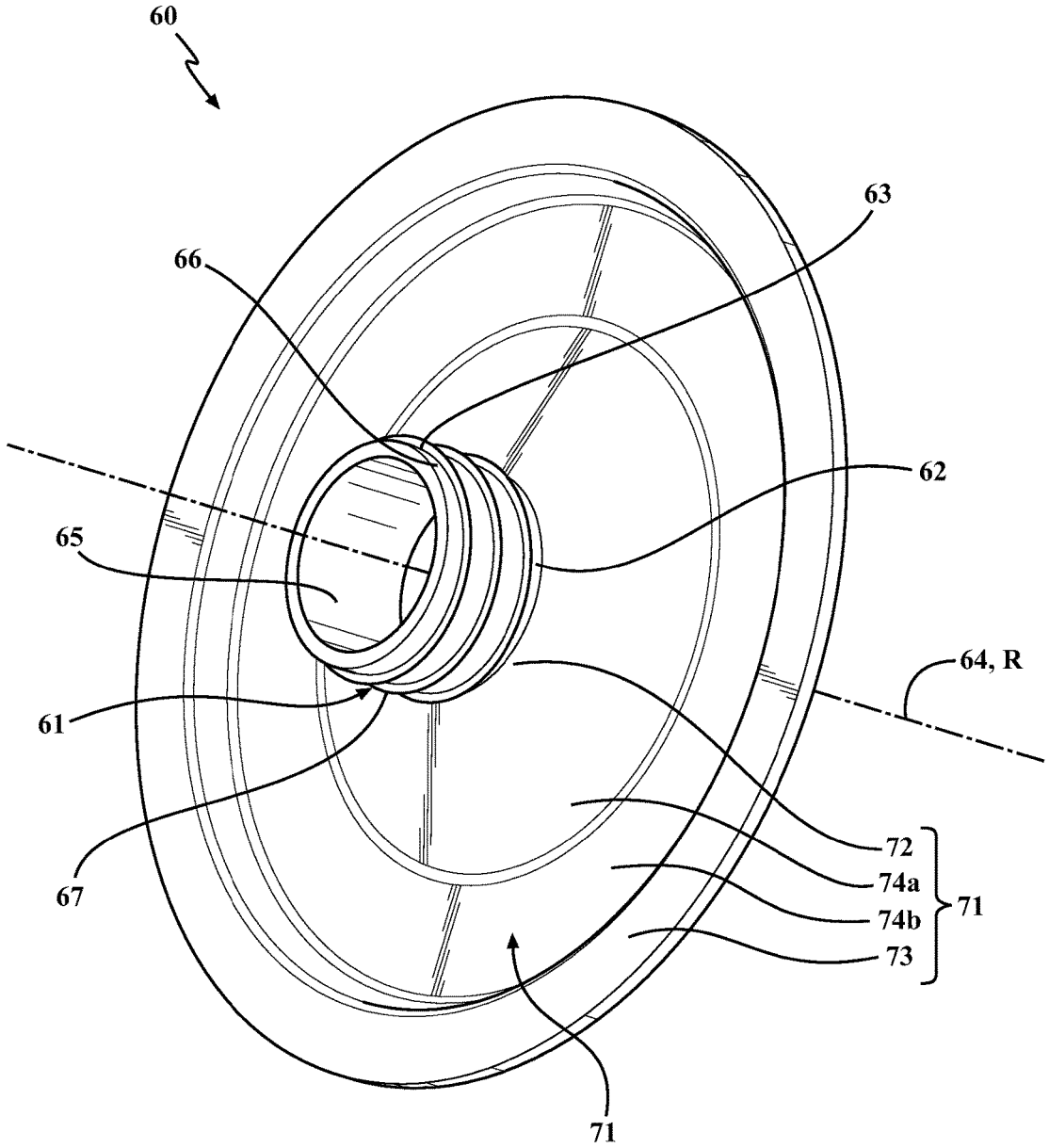
FIG. 3 is a perspective view of the retainer of FIG. 2.

Referring to FIG. 3, the retainer 60 includes a hollow, cylindrical base portion 61 and a slightly concave plate portion 71 that extends generally radially outward from a first end 62 of the base portion 61. The base portion 61 is elongated and defines a retainer longitudinal axis 64 that coincides with the rotational axis R of the shaft and extends through the first end 62 and an opposed second end 63 of the base portion 61. Threads 67 are formed on the base portion outer surface 66. In use, the second end 63 of the base portion 61 is disposed in a bore 17, formed in the bearing housing 16, with the retainer longitudinal axis 64 coaxial with the shaft 14. In addition, the threads 67 engage corresponding threads 15 formed on the bore inner surface (not labeled), whereby the retainer 60 is fixed to the bearing housing 16. The base portion 61 includes an inner surface 65, dimensioned to receive the shaft 14 therethrough. A seal (not shown) may optionally be provided between the base portion inner surface 65 and the shaft 14 to prevent lubricant leakage from the bearing housing 16 into the turbine housing 4.

The plate portion 71 is non-planar and has a shape that generally matches a shape of a backface of the turbine wheel. In particular, the plate portion 71 includes an inner end 72 that is connected to the base portion first end 63, an outer end that is radially spaced apart from the inner end 72 and forms the annular flange 73. The annular flange 73 resides in a plane P that is transverse to the retainer longitudinal axis 64. The plate portion 71 also includes a concave portion 74 that extends between the inner end 72 and the annular flange 73. The concave portion 74 includes an angled portion 74*a* that adjoins the inner end 72 and angles outward away from the base portion 61 (e.g., toward the turbine wheel 12), and a radially-extending planar portion 74*b* that connects the angled portion 74*a* to the annular flange 73.

Referring again to FIG. 2, when the second end 63 of the base portion 61 is disposed within the bore 17, the first end 62 of the base portion 61 extends into the central opening 34*c* of the upper vane ring 34. In addition, the plate portion 71 is disposed between the turbine wheel 12 and a turbine housing-facing surface 13 of the bearing housing 16, and serves as a heat shield for the bearing housing 16. In further addition, the plate portion 71 resides within the upper vane ring central opening 34*c* such that the annular flange 73 is received in the upper vane ring recess 39.

In use, the plate portion 71 of the retainer 60 applies an axial force to the upper vane ring recess 39 in the direction of the bearing housing 16, whereby the upper vane ring 34 is clamped to the bearing housing 16. As a result, the vane pack 50 is secured to the bearing housing 16, axially and radially located relative to the turbine wheel 12, and mechanically decoupled from the turbine housing 4.

Since the vane pack 50 is mechanically decoupled from the turbine housing, the negative thermal effects of the turbine section 2 on the vane pack 50 are minimized. Moreover, since the retainer 60 is clamped to an inner diameter of the vane pack 50, the vane pack can experience thermal growth with minimal distortion. In addition, the plate portion 71 has some elasticity, and serves as a spring that retains the securely clamped configuration of the vane pack 50 relative to the bearing housing 16.

Figure 4:
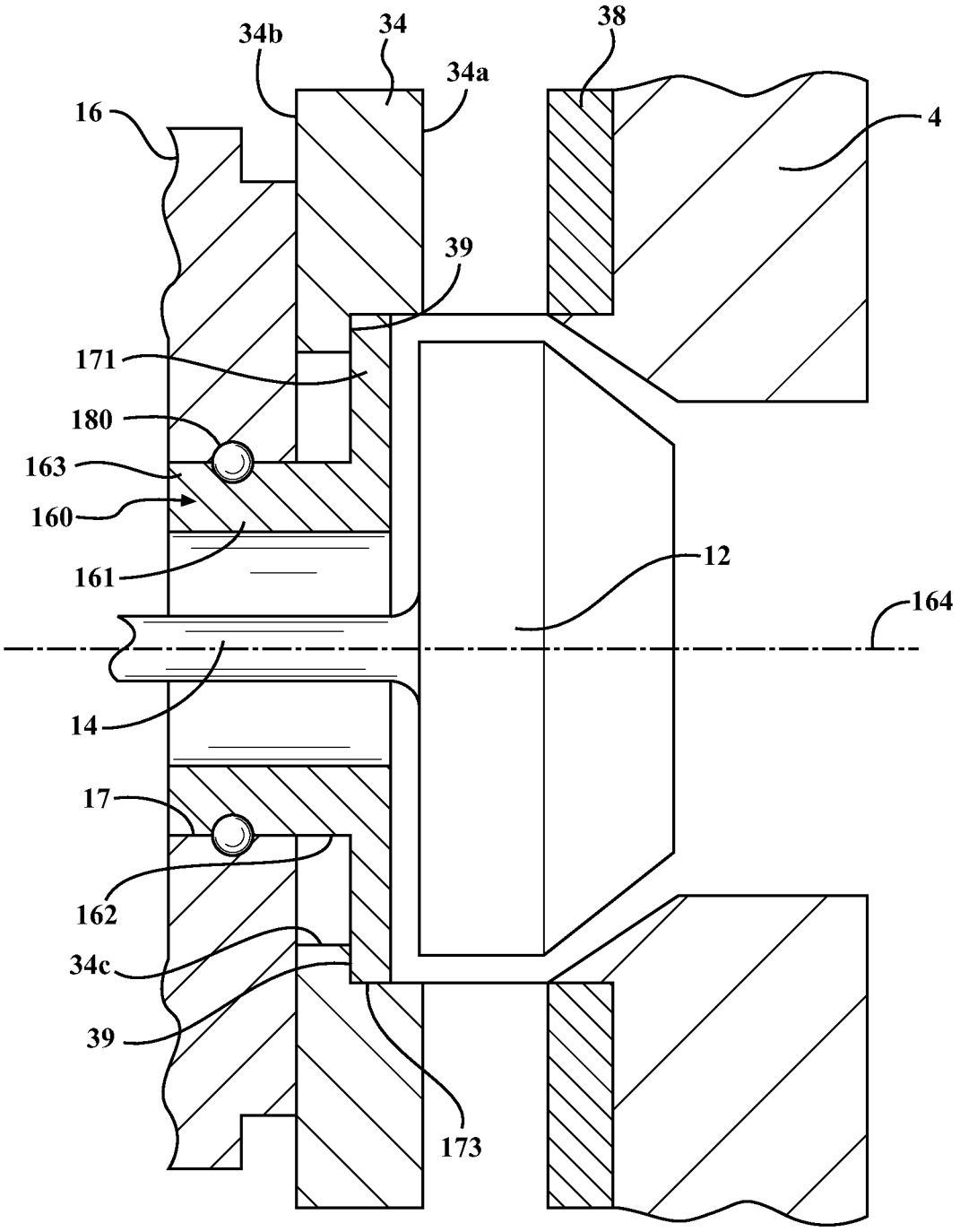
FIG. 4 is a cross-sectional view of a vane pack of a variable geometry turbocharger that is secured to the bearing housing via an alternative embodiment retainer.

Referring to FIG. 4, although the retainer 60 is described herein as being secured to the bearing housing 16 via a threaded engagement between the retainer base portion 61 and the bearing housing bore 17, the retainer 60 is not limited to this type of engagement. For example, an alternative embodiment retainer 160 includes a hollow cylindrical base portion 161, and a plate portion 171 that extends radially outward from one end of the base portion 161. As in the embodiment illustrated in FIG. 2, the base portion 161 includes a first end 162 and an opposing second end 163 wherein the second end 163 is disposed in the bore 17 with the retainer longitudinal axis 164 coaxial with the shaft 14, and an outer end 173 of the plate portion 171 is received within the upper vane ring recess 39. The alternative embodiment retainer 160 differs from the embodiment illustrated in FIG. 2 in that the base portion 161 is thread-free, and is secured to the bearing housing bore 17 via a spring clip 180. Spring clip 180 can be a snap ring or any other similar spring-type retaining means. The spring clip 180 is compressed radially inward, inserted within respective grooves (not labeled) formed in the bearing housing bore 17 and the hollow cylindrical base portion 161, and is retained by expansion into the respective grooves (not labeled) formed in the bearing housing bore 17 and the hollow cylindrical base portion 161.

Aspects described herein can be embodied in other forms and combinations without departing from the spirit or essential attributes thereof. Thus, it will of course be understood that embodiments are not limited to the specific details described herein, which are given by way of example only, and that various modifications and alterations are possible within the scope of the following claims.

The invention claimed is:

1. A variable turbine geometry turbocharger comprising:

a bearing housing including an axially extending bore;

a rotating assembly including a shaft rotatably supported in the bore, a compressor wheel secured to one end of the shaft and a turbine wheel secured to another end of the shaft;

a turbine housing including an exhaust gas inlet, an exhaust gas outlet, a volute disposed in a fluid path between the exhaust gas inlet and the exhaust gas outlet, the turbine wheel disposed in the turbine housing between the volute and the exhaust gas outlet;

a vane pack disposed in the fluid path between the volute and the turbine wheel, the vane pack comprising vanes rotatably supported between a pair of vane rings and configured to adjustably control the flow of exhaust gas to the turbine wheel;

a retainer comprising a base portion and a plate portion extending radially from a first end of the base portion; and wherein the base portion is secured to a surface of the bearing housing defining the axially extending bore to secure the vane pack to the bearing housing so that the vane pack is mechanically decoupled from the turbine housing.

2. The turbocharger of claim 1, wherein the pair of vane rings includes an upper vane ring disposed on a bearing housing-facing side of the vanes, and a lower vane ring disposed on a turbine housing-facing side of the vanes, the upper vane ring is an annular plate having bearing housing-facing surface and an opposed, turbine housing-facing surface, the turbine housing-facing surface including a circumferentially extending recess formed along an inner diameter thereof, and the retainer includes an annular flange that is received in the recess.

3. The turbocharger of claim 1, wherein the plate portion is non-planar and has a shape that matches a shape of a backface of the turbine wheel.

4. The turbocharger of claim 1, wherein the plate portion includes an inner end connected to the one end of the base portion, an annular flange that is radially spaced apart from the inner end, and a concave portion that extends between the inner end and the annular flange.

5. The turbocharger of claim 1, wherein the pair of vane rings includes an upper vane ring disposed on a bearing housing-facing side of the vanes, and a lower vane ring disposed on a turbine housing-facing side of the vanes, and the upper vane ring is clamped between the retainer and the bearing housing.

6. The turbocharger of claim 1, wherein the base portion is hollow and cylindrical and disposed within the axially extending bore so as to be coaxial with the shaft and fixed relative to the bearing housing, and wherein the plate portion is annular and is disposed between the turbine wheel and the bearing housing.

7. The turbocharger of claim 1, wherein the plate portion engages one vane ring of the pair of vane rings.

8. The turbocharger of claim 1, wherein the base portion includes threads formed on an outer surface thereof that engage corresponding threads formed on an inner surface defining the bore and wherein the threads secure the retainer to the bearing housing.

9. The turbocharger of claim 1, wherein the base portion is secured to the bore via a spring clip.

10. The turbocharger of claim 1, wherein the retainer is a separate component from the bearing housing.

* * * * *